US006238108B1

(12) United States Patent
Sanada

(10) Patent No.: US 6,238,108 B1
(45) Date of Patent: May 29, 2001

(54) IMAGE FORMING APPARATUS

(75) Inventor: Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/415,203

(22) Filed: Oct. 12, 1999

(30) Foreign Application Priority Data

Oct. 13, 1998 (JP) ..... 10-290451

(51) Int. Cl.[7] ..... G03D 5/00
(52) U.S. Cl. ..... 396/604; 396/605; 396/609
(58) Field of Search ..... 396/604–609; 430/351, 353, 203, 330, 403

(56) References Cited

U.S. PATENT DOCUMENTS 2,848,931 * 8/1958 Troidl ..... 396/605
2,930,302 * 3/1960 Tuttle ..... 396/605
6,022,673 * 2/2000 Ishikawa ..... 430/351
6,030,755 * 2/2000 Matsumoto et al. ..... 430/351

FOREIGN PATENT DOCUMENTS 9-258402 10/1997 (JP) ..... G03C/8/40
11-84609 3/1999 (JP) ..... G03C/7/42

* cited by examiner

*Primary Examiner*—D. Rutledge
(74) *Attorney, Agent, or Firm*—Sughrue, Mion, Zinn, Macpeak & Seas, PLLC

(57) ABSTRACT

Water is first applied to a film by an applying device. Next, the film to which water is applied is heated and conveyed by a single heating drum. Plural chemical reactions are conducted in such a manner that a development processing sheet and a fixing processing sheet are sequentially superposed on the film in accordance with chemical reaction processes, and thereafter, are peeled from the film. As described above, due to the plural chemical reactions being conducted during a period of time in which the film is heated and conveyed by the single heating drum, non-uniform processing of the film when the film is transferred from one processing to another one does not occur.

12 Claims, 5 Drawing Sheets

IMAGE FORMING APPARATUS

BACKGROUND OF THE INVENTION

1. Field of the Invention

The present invention relates to an image forming apparatus in which a photosensitive material is subjected to chemical processings in a step-by-step manner.

2. Description of the Related Art

There has conventionally been proposed an image forming apparatus in which a photosensitive material, on which an exposed image is formed by heating, is subjected to development processing in such a manner that the photosensitive material, to which a liquid is applied by an applying device, is wound onto a heating drum and a processing sheet is superposed on the photosensitive material. Light transmitted through a dye image of the photosensitive material is digitally read by a CCD sensor of a reading section 50 (see FIG. 5) and is stored. Thereafter, silver contained in the photosensitive material is recovered by a desilvering device 52. The photosensitive material and the processing sheet, which are described above, are shown in detail in Japanese Patent Application Laid-Open Laid-Open (JP-A) No. 9-258402, and Japanese Patent Application Laid-Open Laid-Open (JP-A) No 11-84609.

The present inventors have examined as to whether a development reaction and a fixing reaction can proceed concurrently in such an image forming apparatus.

When two processing sections for a development reaction and a fixing reaction are provided, as shown in FIG. 5, a heating drum 56 used for the development reaction and a heating drum 58 used for the fixing reaction are required.

Applying devices 60 and 62 which are each used to apply a required solvent to a film N, a development processing sheet 64 on which a layer of mordant for development of the film N is formed, and a fixing processing sheet 66 on which a layer of mordant for fixing processing of the film N is formed must be provided in such a manner that the heating drum 56, the applying device 60, and the fixing processing sheet 64 form a set for development, and the heating drum 58, the applying device 62, and the fixing processing sheet 66 form a set for fixing.

However, there is the problem that, if the number of processings increases, an additional set must be added for each additional processing, and therefore, the image forming apparatus is made larger.

Further, in the applying device 62 at the downstream side in a direction in which the film N is conveyed, the problem of turbidity arises due to water-soluble substances adhering to the film N dissolving in the liquid filled in the applying device 62. As a result, the material formulations of the development processing sheet 64 which can be used are restricted considerably. Accordingly, there may be considered a method in which the film N is dried before the film N reaches the applying device 62. However, in this case, the mechanism of the apparatus becomes more complicated, which is not practical.

Moreover, when the film N is conveyed from the heating drum 56 to the heating drum 58 via conveying roller pairs 68 and 70, a state in which the film N is not conveyed uniformly arises, and therefore, uniform development processing cannot be achieved.

SUMMARY OF THE INVENTION

In view of the above-described facts, it is an object of the present invention to realize plural chemical reaction processes of a photosensitive material by a small and simple apparatus and to prevent contamination of a solvent filled in an applying device.

According to a first aspect of the present invention, there is provided an image forming apparatus in which a dye image is formed on an exposed photosensitive material, comprising: a solvent applying device which applies a solvent to the photosensitive material; a single heating and conveying device which heats and conveys the photosensitive material to which the solvent is applied; and a plurality of processing members which are, in accordance with chemical reaction processes, sequentially superposed on the photosensitive material which is being heated and conveyed by the heating and conveying device, and thereafter, are peeled from the photosensitive material.

As described above, due to the plural chemical reaction processes being conducted during the period of time in which the photosensitive material is heated and conveyed by the single heating and conveying device, the photosensitive material is not processed non-uniformly when it is conveyed from one processing to another, and a desirable dye image is thereby formed on the photosensitive material. Further, it is not necessary to provide a set of a heating and conveying device, a solvent applying device, and a processing member for each chemical reaction process, and therefore, a small-sized and simple apparatus can be realized.

A second aspect of the present invention is characterized in that, in the first aspect of the present invention, an overlapping length of each processing member by which the processing member overlaps with the photosensitive material is in proportion to a processing time of the processing member. Due to the structure thus provided, even if the heating and conveying device is driven at a fixed speed, sufficient time for the chemical reaction process of each processing member can be ensured.

A third aspect of the present invention is characterized in that, in the first or second aspect of the present invention, immediately after a processing member disposed at an upstream side in a direction in which the photosensitive material is conveyed is peeled from the photosensitive material, a processing member disposed at a downstream side in the direction in which the photosensitive material is conveyed is superposed on the photosensitive material.

As a result, even if the additional solvent is not applied to the photosensitive material during the processings, the solvent does not evaporate until the final processing by the processing member disposed at the downstream side is completed, and the solvent applied by the solvent applying device can be continuously utilized. Accordingly, one solvent applying device suffices.

Further, water-soluble substances from the photosensitive material before processing do not dissolve in and come off into the solvent applied by the solvent applying device, and therefore, the problem of turbidity does not occur.

According to a fourth aspect of the present invention, there is provided an image forming apparatus in which a dye image is formed on an exposed photosensitive material, comprising: a single heating and conveying device which heats and conveys the photosensitive material; a plurality of processing members which are, in accordance with chemical reaction processes, sequentially superposed on the photosensitive material which is being heated and conveyed by the heating and conveying device, and thereafter, are peeled from the photosensitive material; and a solvent applying device which applies a solvent to the plurality of processing members.

In the aforementioned structure, it is not necessary that the solvent be applied to the photosensitive material, and therefore, there is no possibility that substances of the photosensitive material will dissolve into the solvent.

A fifth aspect of the present invention is characterized in that, in the first to fourth aspects of the present invention, a drying section which dries the photosensitive material is provided immediately after a processing member, which is disposed the furthest downstream in the direction in which the photosensitive material is conveyed, is peeled from the photosensitive material. Since the drying section is thus provided to allow forced drying of the photosensitive material, the photosensitive material can be immediately transferred to a subsequent reading process.

DESCRIPTION OF THE PREFERRED EMBODIMENTS

Figure 1:
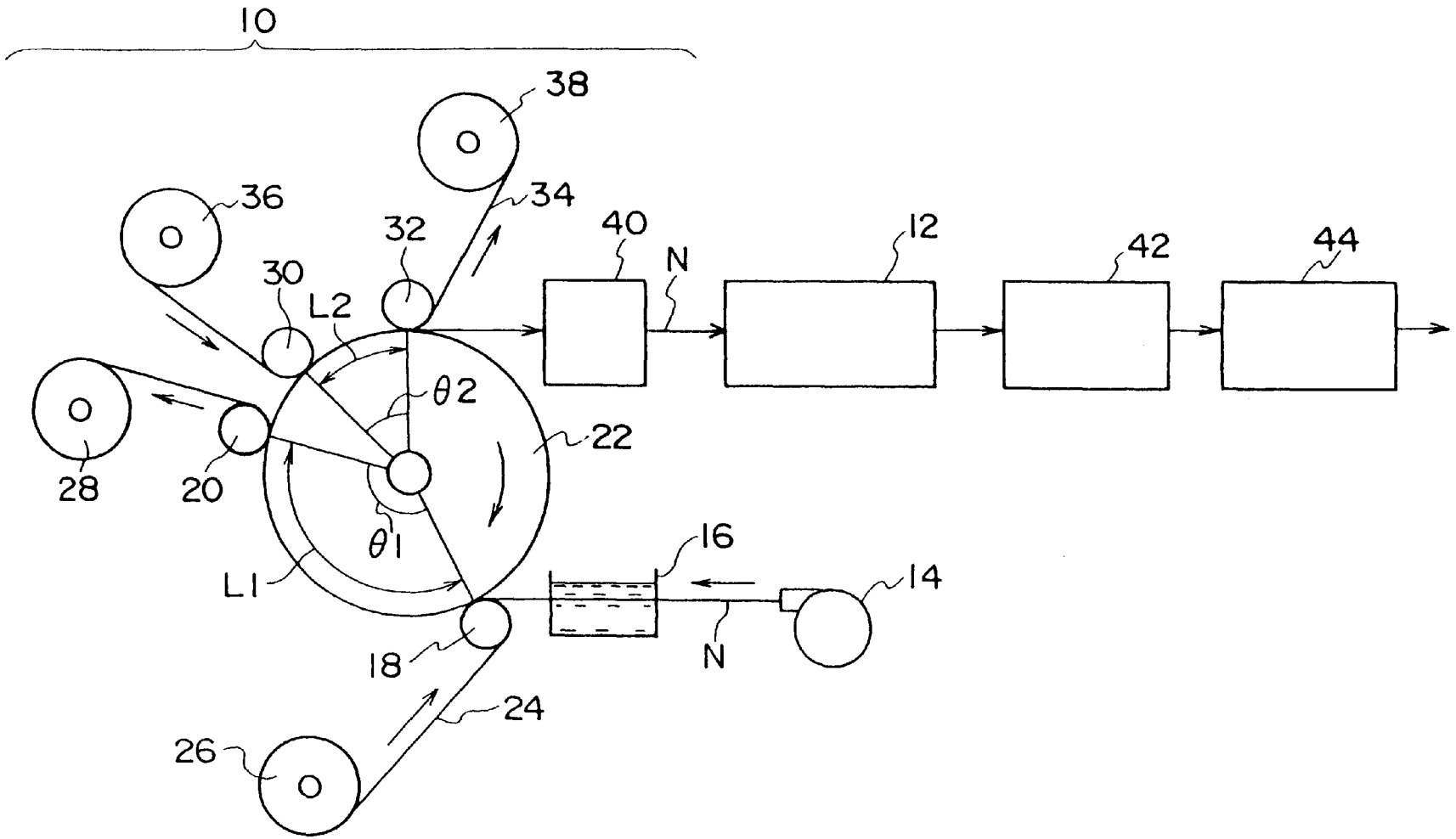
FIG. 1 is an explanatory diagram which illustrates an image forming apparatus according to an embodiment of the present invention.

As shown in FIG. 1, an image forming apparatus according to an embodiment of the present invention includes a development section 10 in which a film N on which an image is recorded (for example, an image photographed by using a camera), and a reading section 12 in which the image recorded on the film N is read digitally.

In the development section 10, a cartridge 14 in which the film N is accommodated is loaded. The film N is pulled out from the cartridge 14 and is conveyed by a conveying roller (not shown) toward an applying device 16 serving as a solvent applying device.

Water is filled in the applying device 16 and the film N is completely soaked in the water. The film N to which water is applied (see FIG. 2) is wound on a heating drum 22 by conveying rollers 18 and 20.

A heater is disposed within the heating drum 22, and the film N wound on the heating drum 22 is conveyed while being heated. Further, a development processing sheet 24 which has, on a support thereof, a layer containing a mordant used for development of the film N is trained around the conveying rollers 18 and 20 and is superposed on the film N wound on the heating drum 22 to thereby allow development processing of the film N. Further, the development processing sheet 24 serves to prevent evaporation of water applied to the film N and also serves as a belt which applies a fixed pressure to the film N.

The development processing sheet 24 is pulled out from a supply reel 26 and superposed on the film N at the conveying roller 18, thereby allowing development processing of the film N. Subsequently, the development processing sheet 24 is peeled from the film N at the conveying roller 20 and wound up on a take-up reel 28. For this reason, fresh mordant can be supplied constantly, and there is no possibility of the apparatus being contaminated as when a developing solution is used, and further, a recovery operation of the development processing sheet 24 is simple.

Next, the film N from which the development processing sheet 24 has been peeled is subjected to fixing processing in such a manner that, with the film N being wound on the heating drum 22, a fixing processing sheet 34 trained about conveying rollers 30 and 32 is superposed on the film N at a fixed pressure. The fixing processing sheet 34 has, on a support thereof, a layer containing a mordant used for fixing the film N. The fixing processing sheet 34 is pulled out from a supply reel 36 and superposed on the film N at the conveying roller 30 to thereby allow fixing processing of the film N. After the fixing processing, the fixing processing sheet 34 is peeled from the film at the conveying roller 32 and is taken-up by a take-up reel 38. The film N is thus subjected to the development and fixing processings in a state of being wound on the single heating drum 22, and therefore, the film is not conveyed non-uniformly when the film is transferred between the development and fixing processings.

Figure 2:
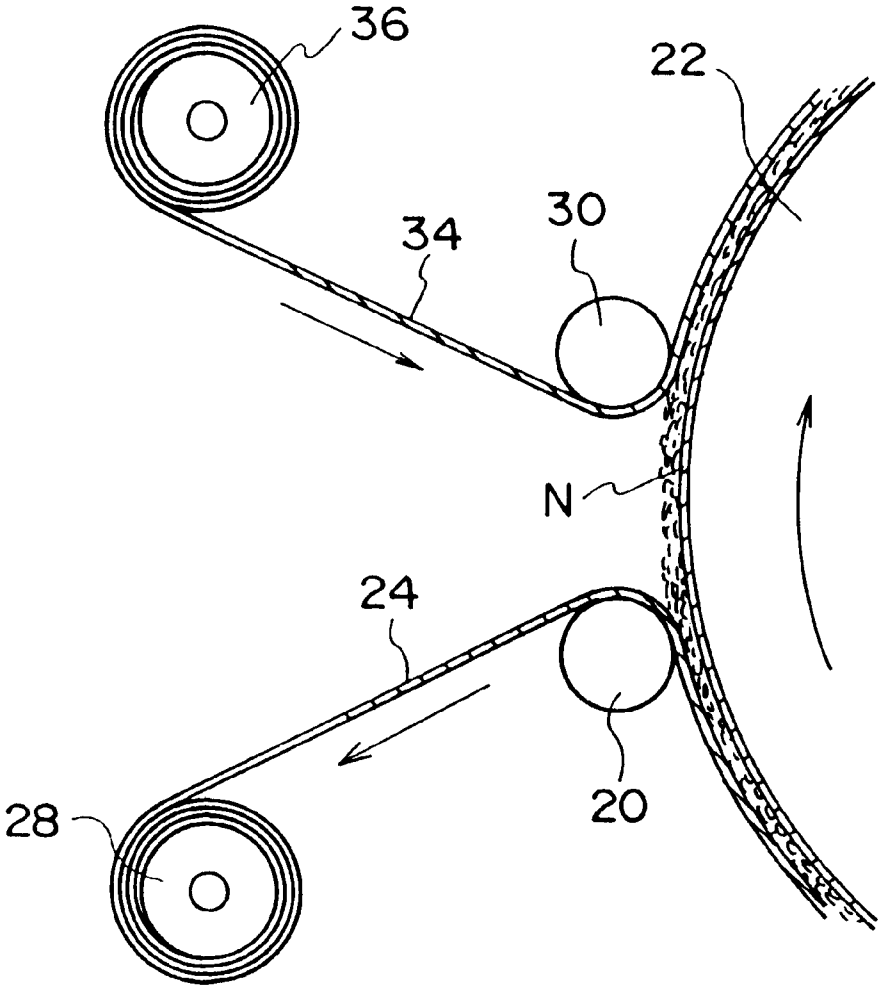
FIG. 2 is a cross-sectional view which shows a principal portion of the image forming apparatus according to the embodiment of the present invention.

The water applied to the film N does not evaporate in a state in which the development processing sheet 24 is superposed on the film N (see FIG. 2). Immediately after the development processing sheet 24 is peeled from the film N, evaporation of the water starts. Accordingly, the fixing processing sheet 34 must be superposed on the film immediately after the development processing sheet 24 has been peeled therefrom. It is important that the distance between the conveying rollers 20 and 30 is set such that all water applied to the film N does not evaporate from between the roller 20 and the roller 30 and an amount of water required for fixing processing is carried over to the fixing processing.

In the present embodiment, the distance between the conveying rollers 20 and 30 is substantially equal to a diameter of each roller. Under such conditions, if 10 cc of water is first applied to the film N, 8 cc of water remains on the film N when the fixing processing sheet 34 is superposed on the film N.

The respective longitudinal dimensions of the development processing sheet 24 and the fixing processing sheet 34 in a state of being superposed on the heating drum 22 (i.e., along the conveying path) is determined by a distance L1 between the conveying rollers 18 and 20 on the circumference of the heating drum 22 and a distance L2 between the conveying rollers 30 and 32 on the circumference of the heating drum 22. Namely, in the present embodiment, the heating drum 22 having a heating temperature of 80° C. is used (the rotating speed thereof is fixed). Assuming that the time for development processing is set to be 15s and the time for fixing processing is set to be 5s, the following equation is established: $L1=3\times L2$. These distances L1 and L2 can be calculated by angles of the heating drum 22 ($\theta1=135°$ and $\theta2=45°$).

On the other hand, the film N from which the fixing processing sheet 34 is peeled is separated from the heating drum 22 due to the inherent stiffness of the film N (or by using a peeling claw) and reaches a drying section 40 in which the film N is subjected to drying processing. As described above, when the film N is dried forcibly, the distance over which the film N travels when transferred to the reading section 12 can be made shorter.

The reading section 12 is comprised of a line sensor for reading the R, G, and B components of an image, and digitally reads an image based on light transmitted through the film N at a position, wherein the image is read per color component by line units of the reading section.

Image data for each of the color components read by the reading section 12 is transferred to a storage section 42 and the image data is stored on a floppy disk or the like. Further, the film N after the image has been read is subjected to desilvering processing by a desilvering device 44 and is recycled.

Figure 3:
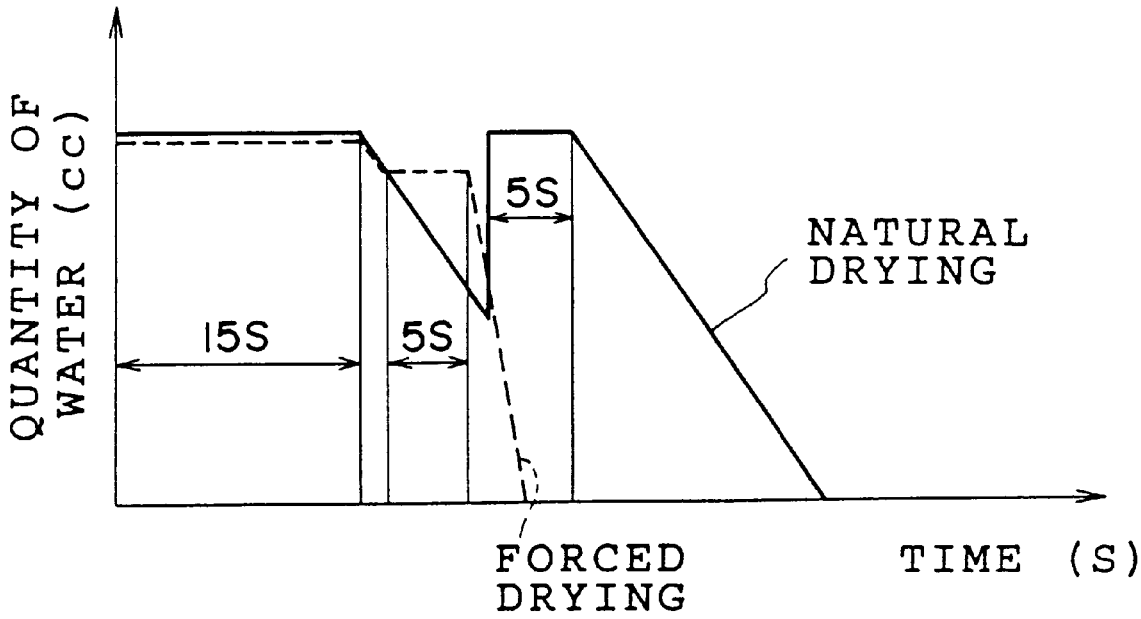
FIG. 3 is a graph for a comparison of the image forming apparatus according to the embodiment of the present invention and a different image forming apparatus.
Figure 5:
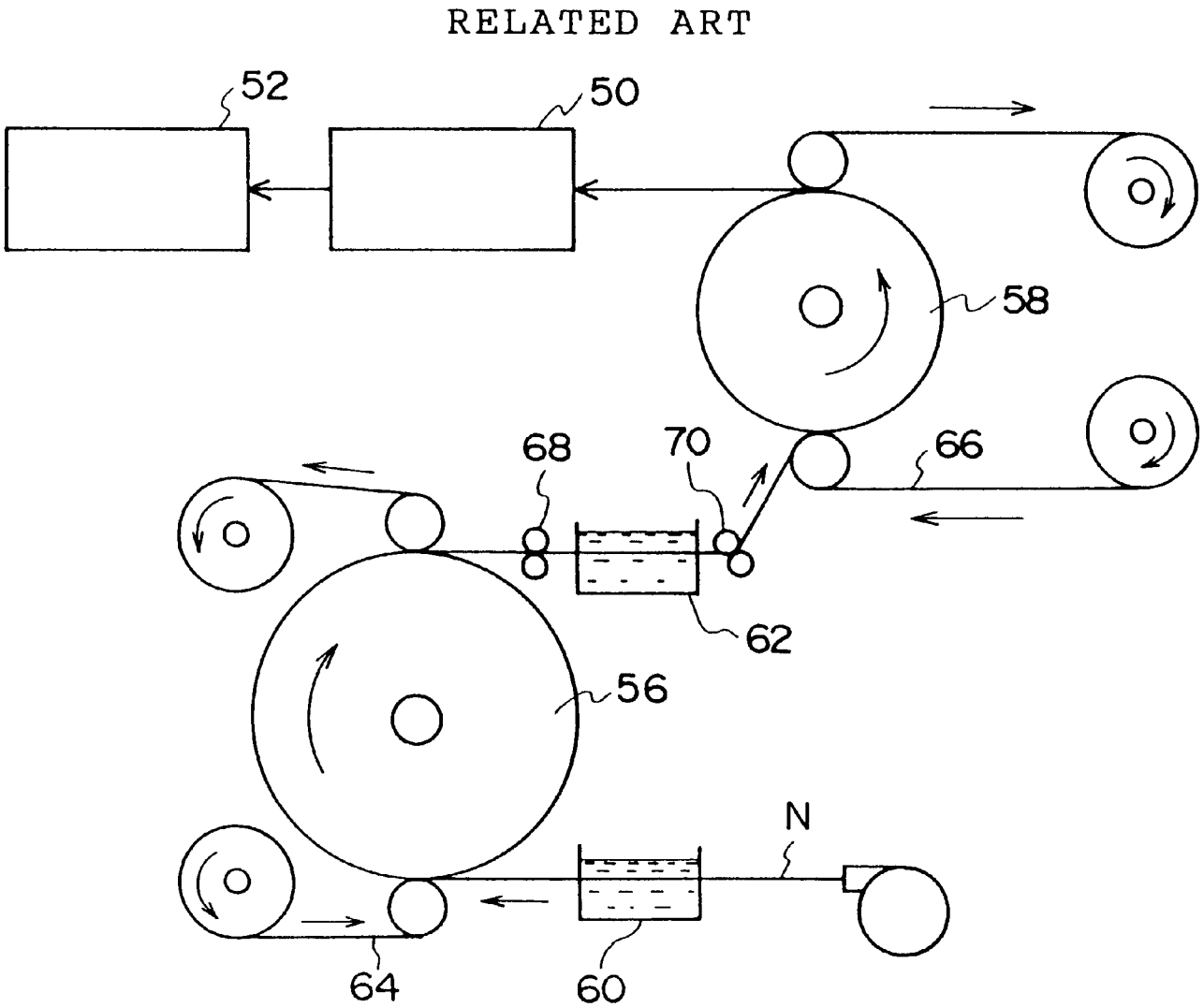
FIG. 5 RELATED ART
FIG. 5 is an explanatory diagram which illustrates a conventional image forming apparatus.

Referring now to the graph shown in FIG. 3, the conventional image forming apparatus in FIG. 5 (indicated by the solid line) and the image forming apparatus of the present embodiment are compared with each other.

In the case of the apparatus of FIG. 5 which apparatus is indicated by the solid line, after development processing, the film N moves away from the heating drum 56 simultaneously with the development processing sheet 64 being peeled off therefrom. For this reason, much water applied to the film N evaporates. By supplying water to the film N by the applying device 62, the amount of water required for fixing processing is maintained. Further, the film N naturally dries after the fixing processing, and therefore, a predetermined amount of time needs to be maintained until the film N reaches the reading section 50.

On the other hand, in the case indicated by the broken line (that is, in the present embodiment), in a process from the development processing to the fixing processing, almost all of the water is carried over to the film N, and therefore, it is not necessary that water be supplied again. Further, the film N is actively dried in the drying section 40, and therefore, the time required until the film N reaches the reading section 12 can be made short.

Figure 4:
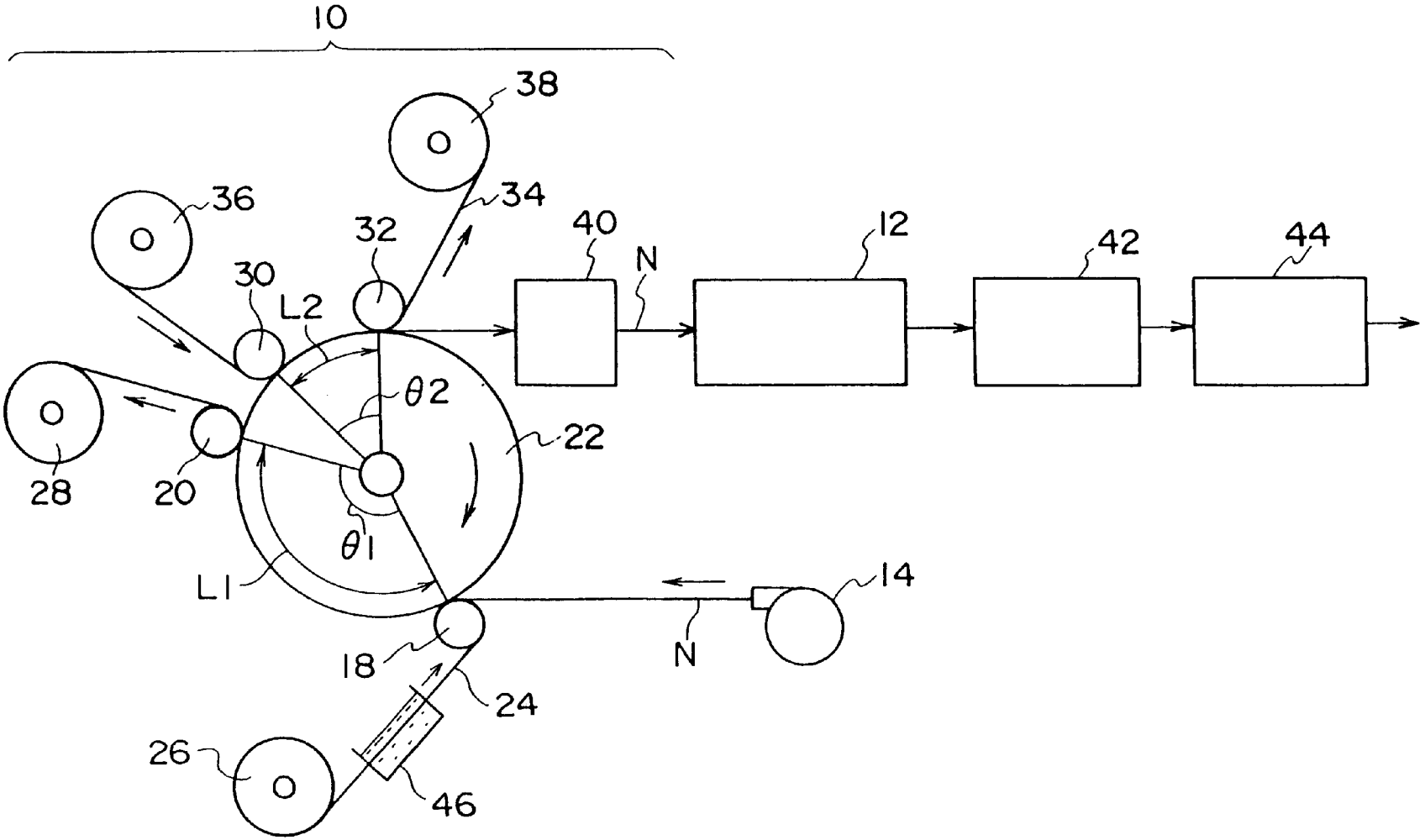
FIG. 4 is an explanatory diagram which illustrates an image forming apparatus according to another embodiment of the present invention.

In the present embodiment, water is applied to the film N by the applying device 16. However, it suffices that water serving as a solvent exists during the heating processing of the film N. As shown in FIG. 4, water may be applied to the development processing sheet 24 by an applying device 46 disposed between the supply reel 26 and the conveying roller 18.

Further, if the diameter of the heating drum is made larger, three or more chemical reaction processings can also be conducted by using a single heating drum.

Moreover, application of water by a single applying device is not necessarily required. For example, water may also be supplied to the film N before the fixing processing. What is important is to decide how long the water first applied to the film N can remain thereon.

What is claimed is:

1. An image forming apparatus in which a dye image is formed on an exposed photosensitive material, comprising:

a solvent applying device which applies a solvent to the photosensitive material;

a single heating and conveying device which heats and conveys the photosensitive material to which the solvent is applied; and a plurality of processing members which are, in accordance with the chemical reaction processes, sequentially superposed on the photosensitive material which is being heated and conveyed by said heating and conveying device, and thereafter, said processing members are peeled from the photosensitive material;

wherein said solvent applying device applies the solvent to the photosensitive material only before said processing members are superposed on the photosensitive material.

2. An image forming apparatus according to claim 1, wherein an overlapping length of each of said plurality of processing members by which each said processing member overlaps with the photosensitive material is in proportion to a processing time of each said processing member.

3. An image forming apparatus according to claim 2, wherein immediately after one of said processing members disposed at an upstream side in a direction in which the photosensitive material is conveyed is peeled from the photosensitive material, another of said processing members disposed at a downstream side in the direction in which the photosensitive material is conveyed is superposed on the photosensitive material.

4. An image forming apparatus according to claim 3, wherein a drying section which dries the photosensitive material is provided directly after one of said processing members, which is disposed the furthest downstream in the direction in which the photosensitive material is conveyed, is peeled from the photosensitive material.

5. An image forming apparatus according to claim 2, wherein a drying section which dries the photosensitive material is provided directly after one of said processing members, which is disposed the furthest downstream in the direction in which the photosensitive material is conveyed, is peeled from the photosensitive material.

6. An image forming apparatus according to claim 1, wherein immediately after one of said processing members disposed at an upstream side in a direction in which the photosensitive material is conveyed is peeled from the photosensitive material, another of said processing members disposed at a downstream side in the direction in which the photosensitive material is conveyed is superposed on the photosensitive material.

7. An image forming apparatus according to claim 6, wherein a drying section which dries the photosensitive material is provided directly after one of said processing members, which is disposed the furthest downstream in the direction in which the photosensitive material is conveyed, is peeled from the photosensitive material.

8. An image forming apparatus according to claim 1, wherein a drying section which dries the photosensitive material is provided directly after one of said processing members, which is disposed the furthest downstream in the direction in which the photosensitive material is conveyed, is peeled from the photosensitive material.

9. An image forming apparatus in which a dye image is formed on an exposed photosensitive material, comprising:

a single heating and conveying device which heats and conveys the photosensitive material;

a plurality of processing members which are, in accordance with chemical reaction processes, sequentially superposed on the photosensitive material which is being heated and conveyed by said heating and conveying device, and thereafter, said processing member which are peeled from the photosensitive material; and a solvent applying device which applies a solvent to said plurality of processing members;

wherein said solvent applying device applies the solvent only to one of said processing members disposed at an upstream side in a direction in which the photosensitive material is conveyed.

10. An image forming apparatus according to claim 9, wherein a drying section which dries the photosensitive material is provided directly after one of said processing members, which is disposed the furthest downstream in the direction in which the photosensitive material is conveyed, is peeled from the photosensitive material.

11. An image forming apparatus in which a dye image is formed on an exposed photosensitive material, comprising:

a single heating and conveying device which heats and conveys the photosensitive material;

a plurality of processing members which are, in accordance with chemical reaction processes, sequentially superposed on the photosensitive material which is being heated and conveyed by said heating and conveying device, and thereafter, said processing members are peeled from the photosensitive material; and a solvent applying device which applies a solvent to said plurality of processing members;

wherein the solvent applying device applies the solvent to said processing members only before said processing members are superposed on the photosensitive material.

12. An image forming apparatus according to claim 11, wherein a drying section which dries the photosensitive material is provided directly after one of said processing members, which is disposed the furthest downstream in the direction in which the photosensitive material is conveyed, is peeled from the photosensitive material.

* * * * *